United States Patent [19]

Söderbaum

[11] 4,275,991

[45] Jun. 30, 1981

[54] BOAT PROPELLER

[75] Inventor: Carl U. Söderbaum, Askim, Sweden

[73] Assignee: AB Volvo Penta, Gothenberg, Sweden

[21] Appl. No.: 48,374

[22] Filed: Jun. 14, 1979

[30] Foreign Application Priority Data

Jun. 27, 1978 [SE] Sweden ..... 7807264

[51] Int. Cl.[3] ..... B63H 1/24

[52] U.S. Cl. ..... 416/142; 416/140; 416/134 R

[58] Field of Search ..... 416/140 R, 142, 134 R, 416/142 B, 142 A

[56] References Cited

U.S. PATENT DOCUMENTS

| | | | |
|---|---|---|---|
| 938,290 | 10/1909 | Thompson | 416/142 |
| 1,682,893 | 9/1928 | De La Cierva | 416/140 |
| 2,198,475 | 4/1940 | Dorner | 416/142 X |
| 2,500,382 | 3/1950 | Rowley | 416/142 |
| 3,113,625 | 12/1963 | Conover | 416/124 R X |
| 3,187,820 | 6/1965 | Maloof | 416/140 |
| 3,565,544 | 2/1971 | Marshall | 416/134 R X |
| 3,981,613 | 9/1976 | Ehrenskjold et al. | 416/142 |
| 4,086,025 | 4/1978 | Astrand | 416/142 |
| 4,094,614 | 6/1978 | Munk et al. | 416/142 |
| 4,095,919 | 6/1978 | Ehrenskjold et al. | 416/142 |
| 4,204,806 | 5/1980 | Blanchard | 416/142 A |

FOREIGN PATENT DOCUMENTS

| | | | |
|---|---|---|---|
| 411631 | 3/1925 | Fed. Rep. of Germany | 416/142 |
| 2349929 | 4/1974 | Fed. Rep. of Germany | 416/142 |
| 61987 | 2/1939 | Norway | 416/142 |
| 520474 | 3/1940 | United Kingdom | 416/142 |
| 612461 | 11/1948 | United Kingdom | 416/142 |

*Primary Examiner*—Everette A. Powell, Jr.
*Attorney, Agent, or Firm*—Young & Thompson

[57] ABSTRACT

The invention relates to a boat propeller with foldable blades, a so-called folding propeller. The characteristic feature of the propeller is that it is provided with resilient structure disposed to brake the swinging movement of the blades as they are spread out from the folded position to the operating position.

2 Claims, 3 Drawing Figures

FIG. 1
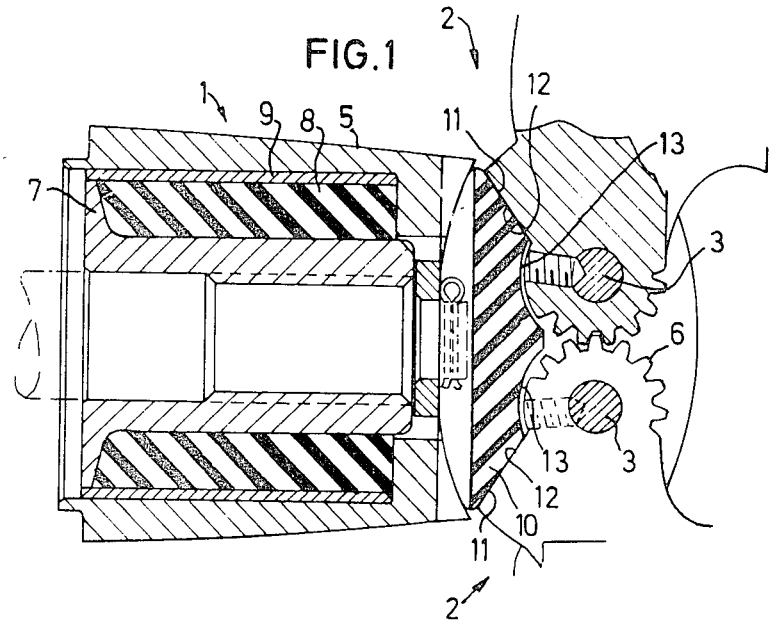
FIG. 2
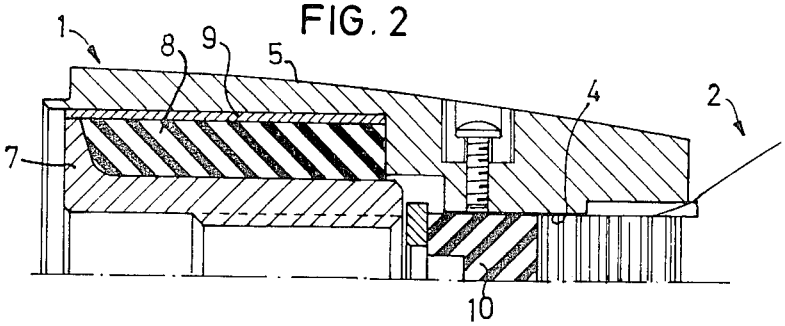
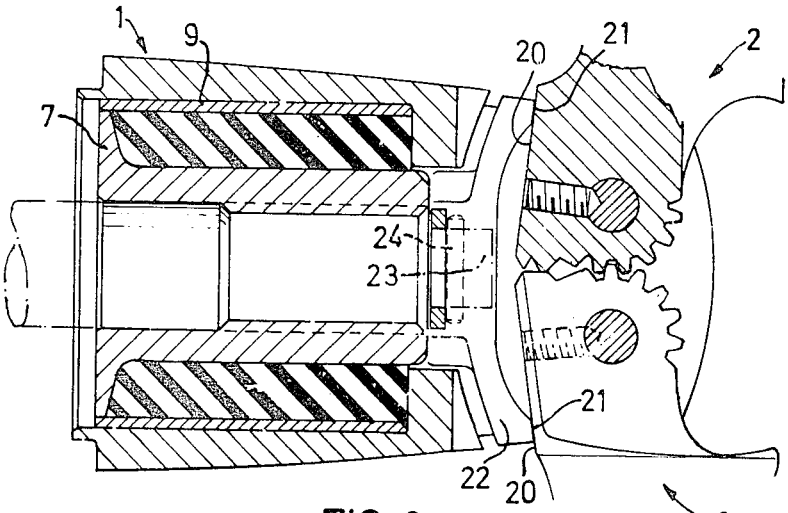
FIG. 3

BOAT PROPELLER

The present invention relates to a device for boats, comprising a hub which is designed to be fixed on a propeller shaft, and a pair of propeller blades carried by the hub and swingably journalled on the hub so that they are movable between a spread-out operating position and a folded position in which the blades extend backwards in the shaft direction, said blades being disposed, under the effect of the centrifugal force when the propeller shaft rotates, to swing out from the last-mentioned position to the operating position.

Propellers of this type, so-called folding propellers, are used primarily in sailboats to reduce the resistance in the water during sailing. While sailing, when the propeller shaft does not rotate, the blades fold together against each other by the water pressure so as to form a smooth extension of the propeller hub. When the motor is started and drives the propeller shaft, the blades spread out to their operating position, being swung about 90° from the folded position.

In order to have the blades spread out quickly enough under the effect of the centrifugal force, the blades must be relatively heavy. For this reason, when the spreading-out movement is stopped as the ends of the blades strike one another, large stresses are applied to the blades and journals. Blades have on occasion broken and journal shafts have been bent. The risk of such damage is possibly not as great when the blades are made of bronze, but it increases when the blades are made of cast iron, which is less expensive and is not as conducive to general corrosion. Such damage is more likely as the propeller diameter and the blade weight increase.

In order to solve the above-mentioned problem, a known propeller design allows the blades to swing beyond the 90° position and find their own balance point. This results, however, in poorer maneuvering capability than when the blades have an operating position fixed by a stop.

The purpose of the present invention is to achieve a propeller of the type described in the introduction, which eliminates the risk of damage as the blades are spread out and at the same time has a defined stop at the operating position of the blades and which, inter alia, permits shifting between forward and reverse at higher r.p.m. than idle.

This is achieved according to the invention by means of a propeller which is provided with flexible means which are disposed to brake the swinging movement of the blades in the vicinity of the operating position when the blades are swung out from their folded position.

The invention will be described in more detail with reference to the examples shown in the accompanying drawing, in which FIG. 1 shows a vertical longitudinal section through a first embodiment of the propeller device, FIG. 2 shows a horizontal longitudinal section through the device in FIG. 1, and FIG. 3 shows a vertical longitudinal section through a second embodiment of the propeller device.

The propeller device shown in FIGS. 1 and 2 consists of a propeller hub 1 and a pair of propeller blades 2, which are swingably journalled on pins 3 in a slot 4 which is cut out of an outer hub member 5. The inner ends of the blades 2 are made in the conventional manner with cogs 6, which engage with each other to synchronize the swinging movement of the blades between their operating position (shown here) 90° to the propeller shaft and a position parallel to the propeller shaft.

The hub 1 has a conventional construction and comprises, in addition to the hub member 5 mentioned above, an inner shaft bushing 7, which is provided with splines for non-rotatable connection with the shaft. A rubber bushing 8 surrounds and is non-rotatably fixed to the shaft bushing 7. A sleeve 9 surrounds and is non-rotatably fixed to the rubber bushing 8. The hub member 5 is non-rotatably fixed to the sleeve 9, e.g. by gluing.

According to the invention, a dampening member 10 of resilient material, e.g. rubber, is placed in the slot 4 in front of the blades 2. The dampening member 10 is made with stop surfaces 11, which are so adapted to the corresponding stop surfaces 12 on the blades that the latter will come into contact with the surfaces 11 just before the blades reach the position 90° to the shaft. The dampening member 10 thus functions as a resilient stop for the blades in the operating position. The stop is clamped between the stop surfaces 12 of the two blades and thus produces a softer braking of the blades than when the blades are stopped end against end. The dampening member 10 is provided with arcuate cavities 13 for the cogs 6 on the blades.

FIG. 3 shows another embodiment of a propeller device according to the invention. A propeller hub 1 carries, in the same manner as the embodiment described above, a pair of swingably journalled propeller blades 2. The hub 1 has the same basic construction as the hub in FIGS. 1 and 2, while the inner ends of the blades have a somewhat modified shape on their stop surfaces 20. They are shaped for cooperation with stop surfaces 21 on a bar 22, which is mounted in the slot 4 in the hub member 5. The bar 22 is fixed on a pin 23 on the propeller shaft by means of a cotter pin 24.

The rubber bushing 8 of the hub, which normally serves to even out the torque, in the embodiment described here will also serve as a dampener as the blades are spread out. When the blades approach the operating position 90° to the shaft, their stop surfaces 20 strike the stop surfaces 21 on the bar 22. Since the bar is fixed relative to the shaft bushing 7 of the hub, continued swinging of the blades will cause them, by a lever effect, to pull the hub member 5 axially backwards relative to the bushing 7 and this applies a shearing stress to the rubber bushing. Thus in this embodiment, a component which is already in the hub is used as an elastic dampener for the spreading movement.

What I claim is:

1. In a propeller device for boats, comprising a hub which is designed to be fixed on a propeller shaft, and a pair of propeller blades carried by the hub and swingably journaled on the hub so that they are movable between a spread-out operating position and a folded position in which the blades extend backward in the shaft direction, said blades having intermeshing cogs thereon whereby they swing conjointly in opposite directions, said blades being disposed, under the effect of the centrifugal force when the propeller shaft rotates, to swing out from the folded position to the operating position; the improvement in which the hub has a slot immediately in front of the blades, and a single resilient damping member disposed in said slot, said damping member having separate spaced stop surfaces one of which is struck by a stop surface on one of the blades in the vicinity of the journaling of the one blade on the hub and the other of which is struck by a stop surface on the other blade in the vicinity of the journaling of the other blade on the hub in order to brake the swinging movement of the blades in the vicinity of said operating position, when the blades are swung out from their folded position, the material of said single damping member being a resilient material that extends continuously along a straight line that extends from one said stop surface on said damping member to the other said stop surface on said damping member, said stop surfaces on the damping member being inclined toward each other.

2. A propeller device as claimed in claim 1, said single resilient damping member having a pair of cavities therein for said cogs, the cogs of one blade being disposed in one said cavity and the cogs of the other blade being disposed in the other said cavity.

* * * * *